US008683732B2

(12) United States Patent
Joplin

(10) Patent No.: US 8,683,732 B2
(45) Date of Patent: Apr. 1, 2014

(54) SCOPE RING AND CLAMPING MECHANISM FOR SCOPE RINGS AND SIMILAR MOUNTS

(76) Inventor: Jered S. Joplin, Jefferson, GA (US)

( * ) Notice: Subject to any disclaimer, the term of this patent is extended or adjusted under 35 U.S.C. 154(b) by 117 days.

(21) Appl. No.: 13/456,499

(22) Filed: Apr. 26, 2012

(65) Prior Publication Data

US 2013/0283663 A1 Oct. 31, 2013

(51) Int. Cl.
*F41G 1/387* (2006.01)

(52) U.S. Cl.
USPC ..... 42/124; 42/90

(58) Field of Classification Search
USPC ..... 42/124–127, 90
See application file for complete search history.

(56) References Cited

U.S. PATENT DOCUMENTS

| | | | | |
|---|---|---|---|---|
| 5,155,915 | A * | 10/1992 | Repa | 42/127 |
| 5,276,988 | A * | 1/1994 | Swan | 42/127 |
| 5,680,725 | A * | 10/1997 | Bell | 42/127 |
| 7,272,904 | B2 | 9/2007 | Larue | |
| 7,430,828 | B2 * | 10/2008 | Munst | 42/72 |
| 7,543,405 | B1 * | 6/2009 | Ivey | 42/125 |
| 7,614,175 | B2 * | 11/2009 | Davis et al. | 42/127 |
| 7,694,450 | B2 * | 4/2010 | Keng | 42/124 |
| 7,757,422 | B1 * | 7/2010 | Swan | 42/96 |
| 7,757,423 | B1 * | 7/2010 | Swan | 42/127 |
| 7,802,395 | B1 * | 9/2010 | Swan | 42/127 |
| 7,823,316 | B2 * | 11/2010 | Storch et al. | 42/90 |
| 7,870,688 | B1 * | 1/2011 | Dasiukevich | 42/124 |
| 7,886,476 | B1 * | 2/2011 | Swan | 42/127 |
| 7,905,045 | B1 * | 3/2011 | Swan | 42/127 |
| 7,908,782 | B1 * | 3/2011 | LaRue | 42/128 |
| 8,112,933 | B1 * | 2/2012 | Swan | 42/127 |
| 8,171,666 | B2 * | 5/2012 | Karagias | 42/124 |
| 8,276,307 | B2 * | 10/2012 | Deros | 42/127 |
| 8,336,244 | B2 * | 12/2012 | Peterson et al. | 42/90 |
| 8,336,247 | B2 * | 12/2012 | Haering | 42/127 |
| 8,397,421 | B2 * | 3/2013 | Ding et al. | 42/124 |
| 8,499,484 | B2 * | 8/2013 | Schneider et al. | 42/124 |
| 8,510,983 | B2 * | 8/2013 | Larue | 42/148 |
| 8,567,105 | B1 * | 10/2013 | Bobro | 42/90 |
| 2006/0123686 | A1 * | 6/2006 | Larue | 42/127 |
| 2008/0072471 | A1 * | 3/2008 | Keng | 42/124 |
| 2008/0168696 | A1 * | 7/2008 | Orne et al. | 42/90 |

* cited by examiner

*Primary Examiner* — Michael David
(74) *Attorney, Agent, or Firm* — R. Tracy Crump

(57) ABSTRACT

The scope ring includes a clamping mechanism, which provides an enhanced connection for Weaver and Picatinny style rails and rail bases. The scope ring includes a base member and a rail clamping member that bolt together at an angle and form the improved clamping mechanism. Tightening the fasteners draws the contact surfaces of the base member and the rail clamping member laterally inward against the sides of the rail base and vertically downward against the top of the rail base.

19 Claims, 10 Drawing Sheets

SCOPE RING AND CLAMPING MECHANISM FOR SCOPE RINGS AND SIMILAR MOUNTS

This invention relates to a scope ring and an attachment mechanism for mounting scope rings and similar mounts to Weaver and Picatinny style mounting bases and rails on firearms and other weapons.

BACKGROUND AND SUMMARY OF THE INVENTION

Weaver and Picatinny style rails and rail bases along with their associated scope rings and mounts are commonly used for mounting optical sights and other accessories to firearms. Weaver and Picatinny style rail bases are typically permanently affixed to or integrated into receiver of the firearm and provide the mounting structure upon which optical sights and other weapon accessories are mounted.

Heretofore, Weaver and Pictanny style scope rings and accessory mounts have opposed clamping members that engage the angulated clamping surfaces on the sides of the rails. The clamping force, which holds the rings or mounts to the rails and bases is provided by locking screws or levered cams that urge the clamping members together laterally against the sides of the rails. Because, the clamping force is applied laterally, any angular deviation between the mating contact surfaces of either the mount or the rail base results in a less than optimal engagement and can result in alignment and cant problems. Furthermore, if the angled contact surfaces do not mate squarely, this lateral clamping force may cause material stress and failure in the mounts and the rail bases over time. Lower grade materials used in manufacturing of scope bases, inconsistent design tolerances from one manufacturer to another and other factors can cause twisting stress and cause the mount to move out of parallel with the weapon. While the locking bar system allows for even stress to be distributed and prevent canting of the scope mount, conventional scope rings are still prone to deviation caused by lateral clamping forces.

The present invention seeks to provide an improved clamping mechanism for securing scope rings and similar accessory mounts to Weaver and Picatinny style rail bases and rails. The scope rings of this invention include a base member and a rail clamping member that bolt together at an angle and form the clamping mechanism of this invention. Because of their angular orientation to the base member about the rail base or rail, drawing down fasteners generates a clamping force having both a vertical and lateral vector. Tightening the fasteners draws the contact surfaces of the base member and the rail clamping member laterally inward against the sides and vertically downward against the top of the rail base. The clamping mechanism of this invention provides a stronger and more stable connection than conventional clamping mechanisms, which rely solely on a lateral clamping force to securely hold their clamping surfaces against the sides of the rail bases and rails.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangements of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
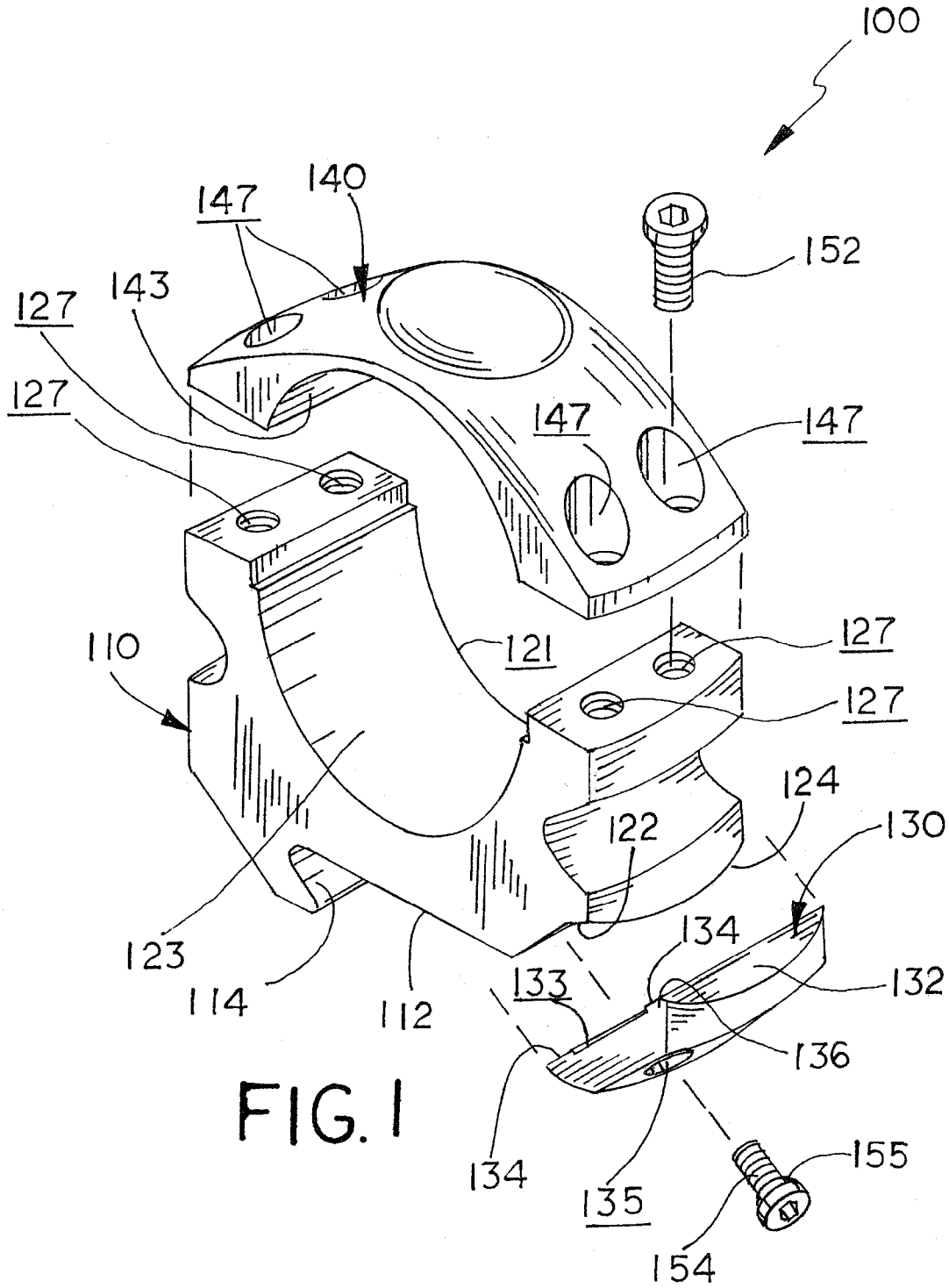
FIG. 1 is a exploded view of an embodiment of the scope ring of this invention.
Figure 2:
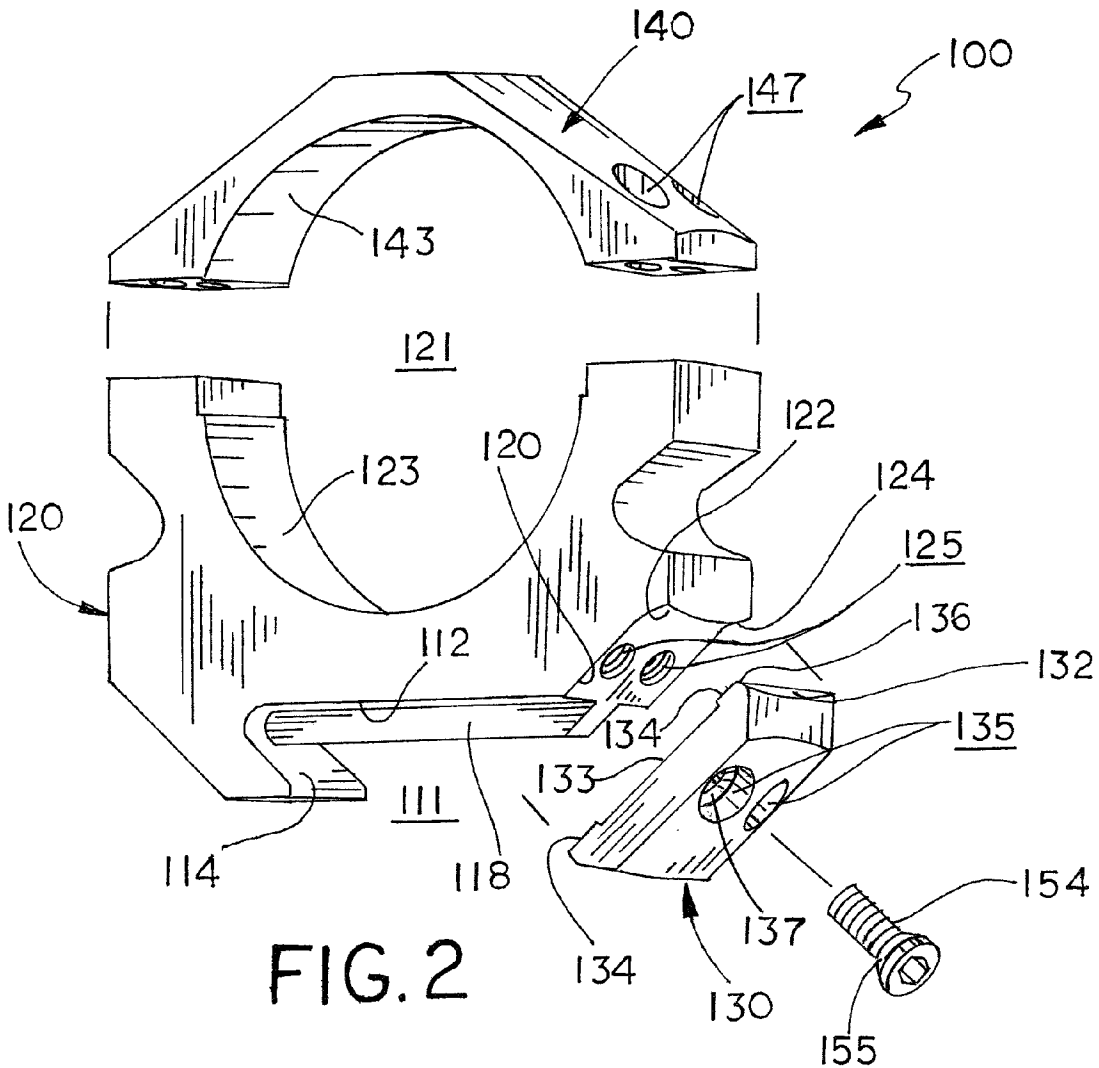
FIG. 2 is another exploded view of the scope ring of FIG. 1.
Figure 3:
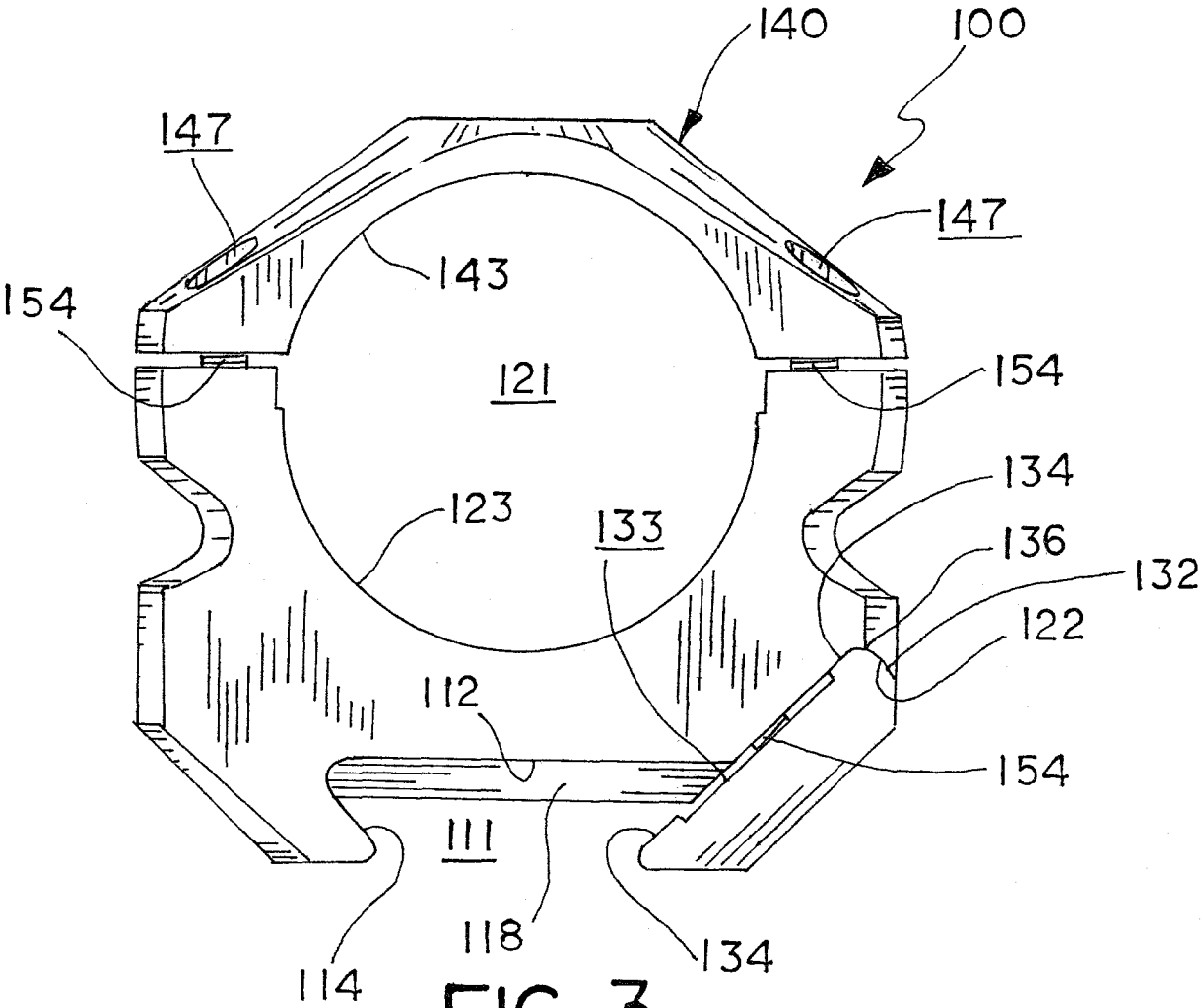
FIG. 3 is an end view of the scope ring of FIG. 1.
Figure 5:
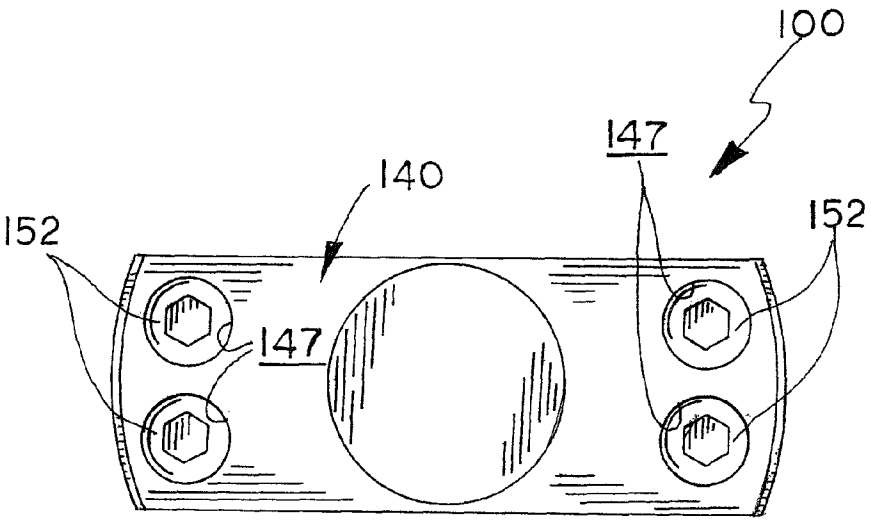
FIG. 5 is a top view of the scope ring of FIG. 1.
Figure 4:
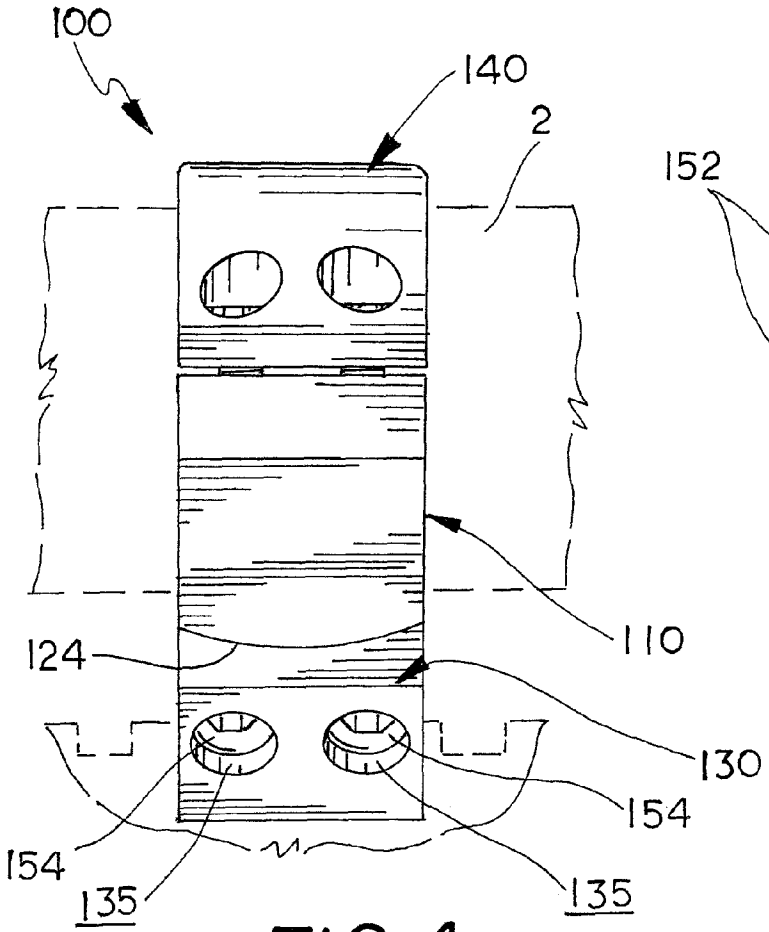
FIG. 4 is a right side view of the scope ring of FIG. 1.
Figure 7:
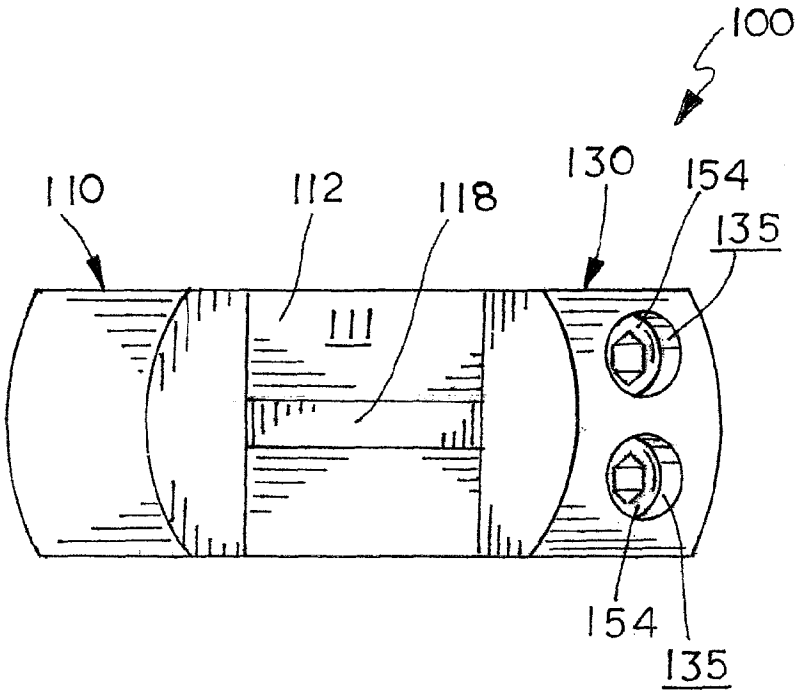
FIG. 7 is a bottom view of the scope ring of FIG. 1.
Figure 6:
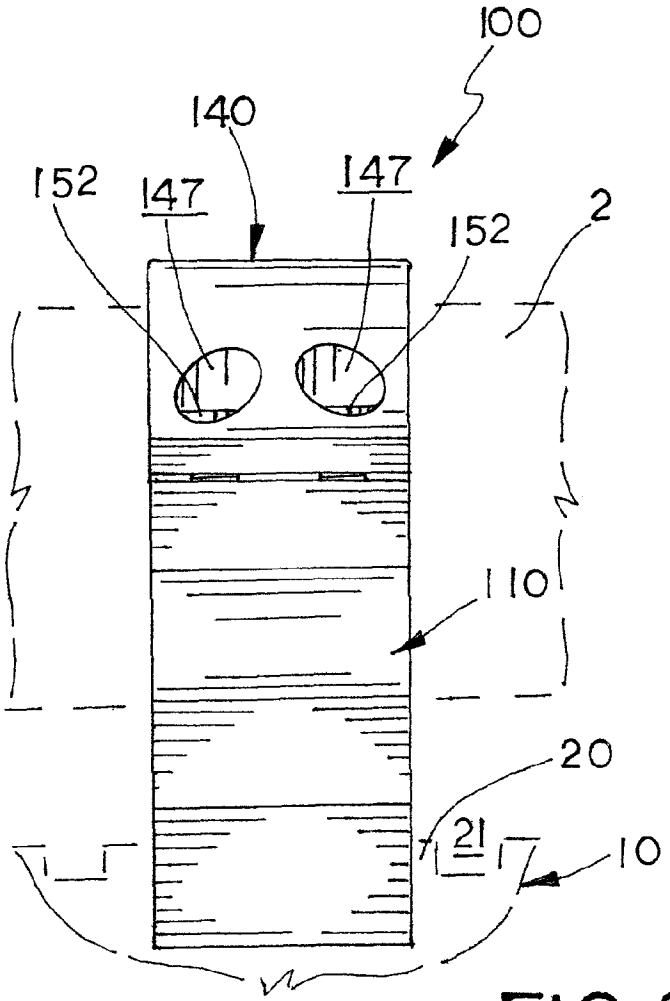
FIG. 6 is a left side view of the scope ring of FIG. 1
Figure 8:
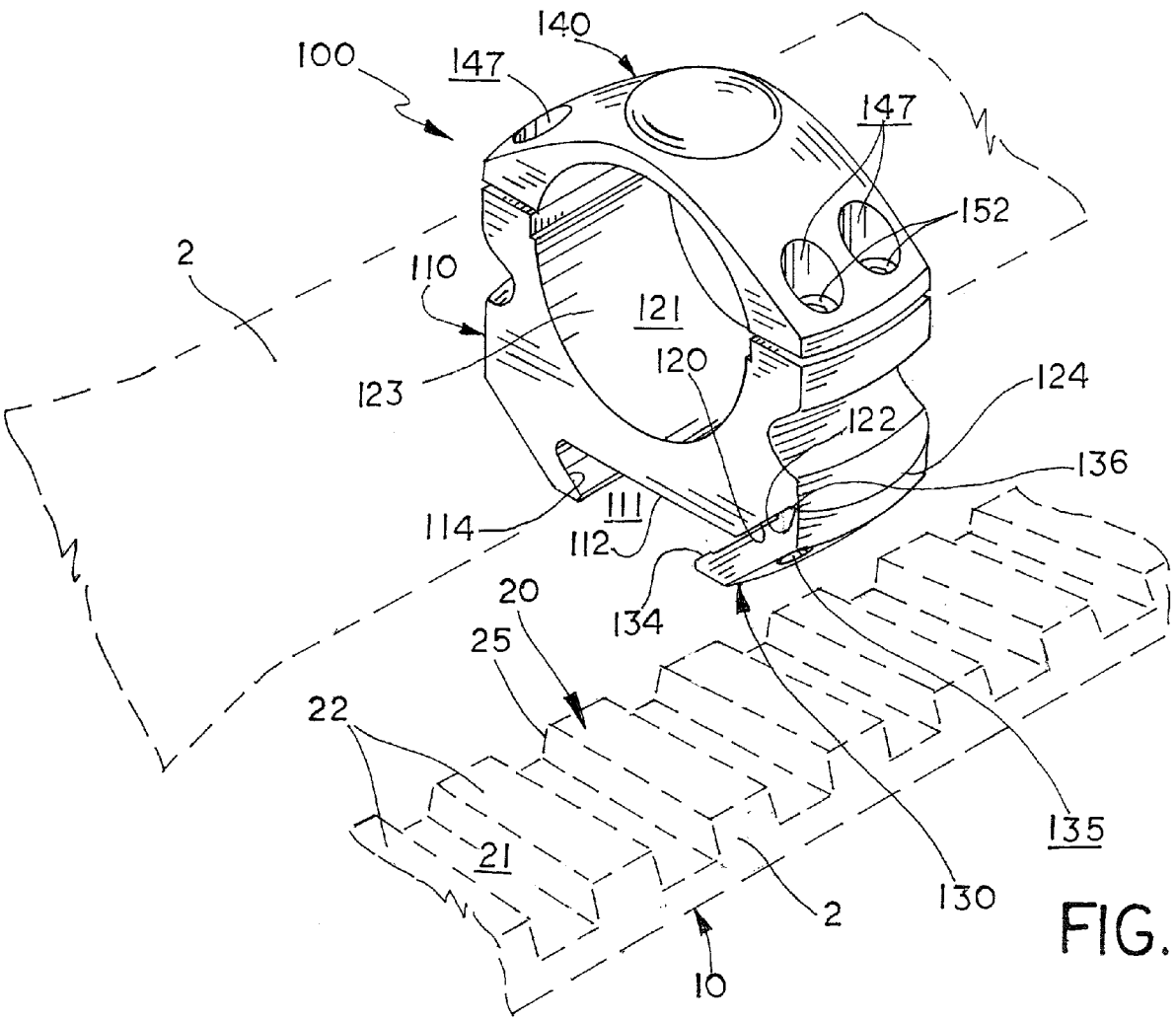
FIG. 8 is a perspective view of the scope ring of FIG. 1 spaced above a conventional Weaver style rail base.
Figure 9:
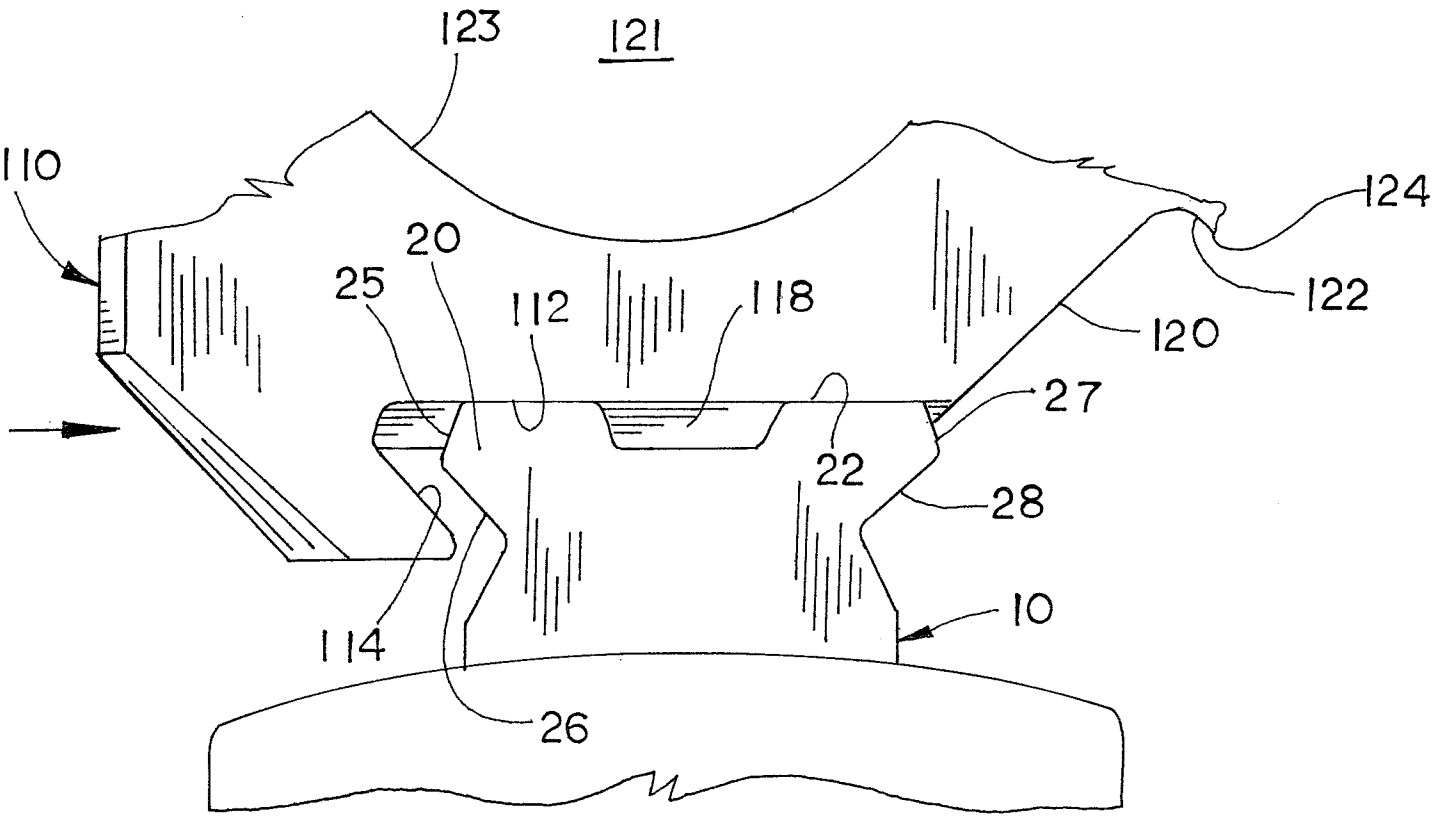
FIG. 9 is a partial end view of the scope ring of FIG. 1 showing the base member sliding onto a Weaver style rail base.
Figure 10:
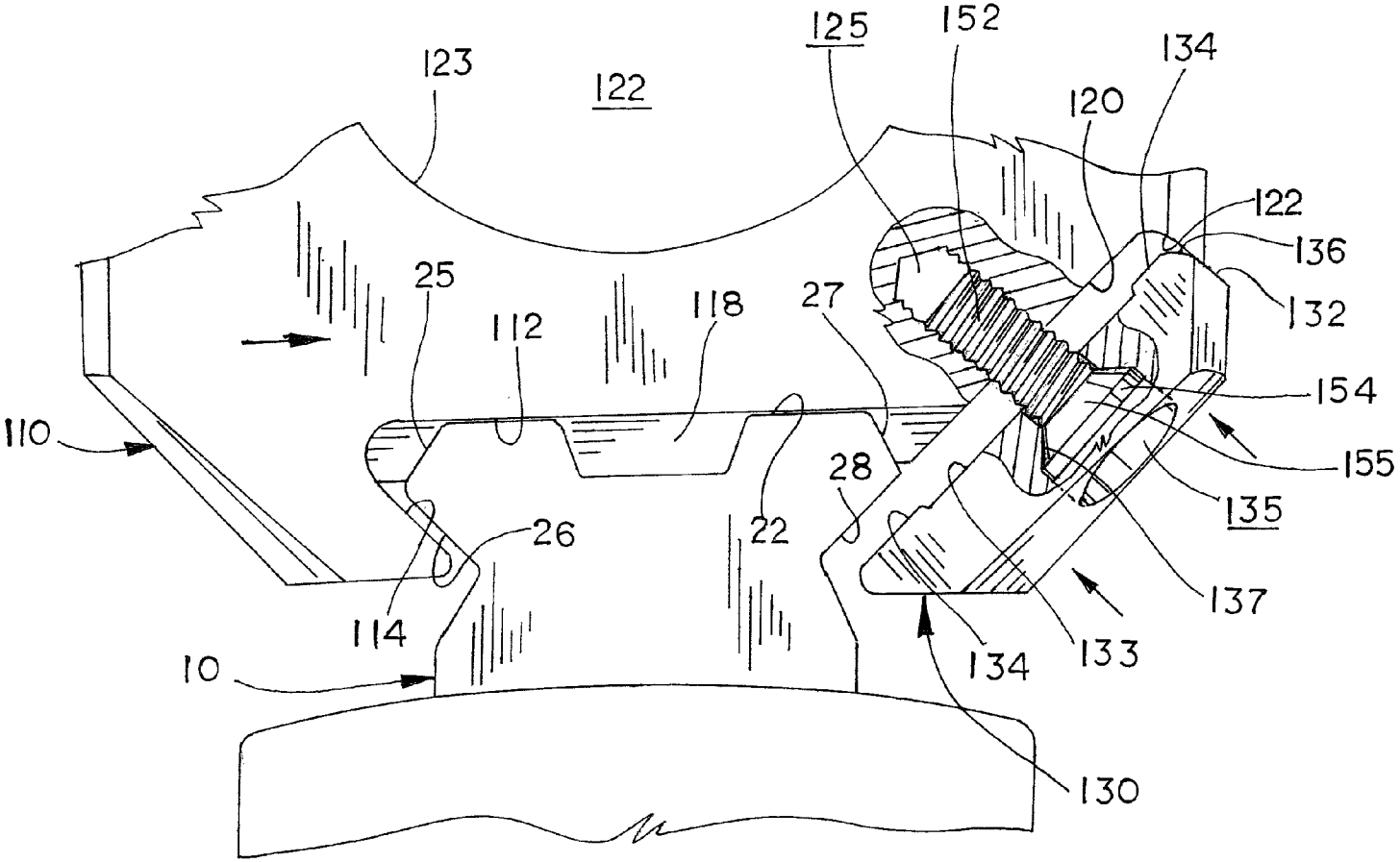
FIG. 10 is an end partial view of the scope ring of FIG. 1 showing the rail clamping member being tightened to the base member over the Weaver style rail base.
Figure 11:
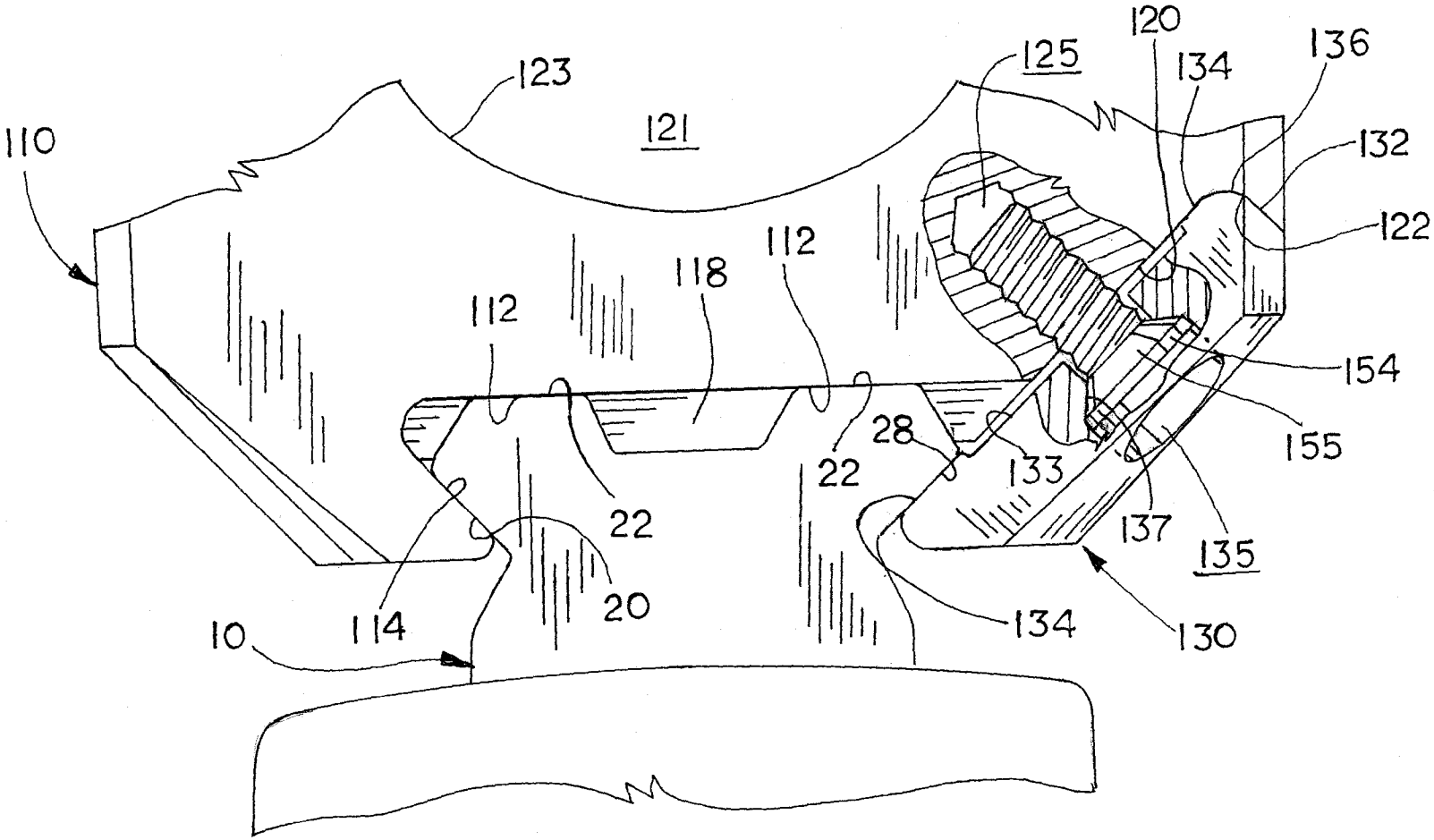
FIG. 11 is a partial end view of the scope ring of FIG. 1 showing the rail clamping member tightened to the base member to secure the scope ring to the Weaver style rail base.

Referring now to the drawings, FIGS. 1-11 illustrate a scope ring, designated generally as reference numeral 100, which incorporates an embodiment of the rail mount mechanism of this invention. While illustrated and described as part of a scope ring, the rail mounting mechanism of this invention may be incorporated into other mounts and devices that are attachable to Weaver and Picatinny style rail bases and rails within the teachings of this invention. In addition, for simplicity of illustration and explanation only, scope ring 100 is illustrated on a Weaver style rail base 10, but may be readily adapted by ones in the art for use on the similar Picatinny style rails and rail bases. Weaver and Picatinny style bases and rails are well known in the firearms industry. Weaver and Picatinny style rails and rail bases allow optical sights and other weapon accessories to be conveniently mounted and secured to weapons. It should be noted that Weaver and Picatinny style rails and rail bases differ only in the slot dimensions and the standardization of the slot spacing between the rail projections. While some scope rings and mounts are designed to fit on both Weaver and Picatinny rails and rail bases, most rings and mounts designed specifically for Picatinny rails may not fit on Weaver rails and bases.

Figure 12:
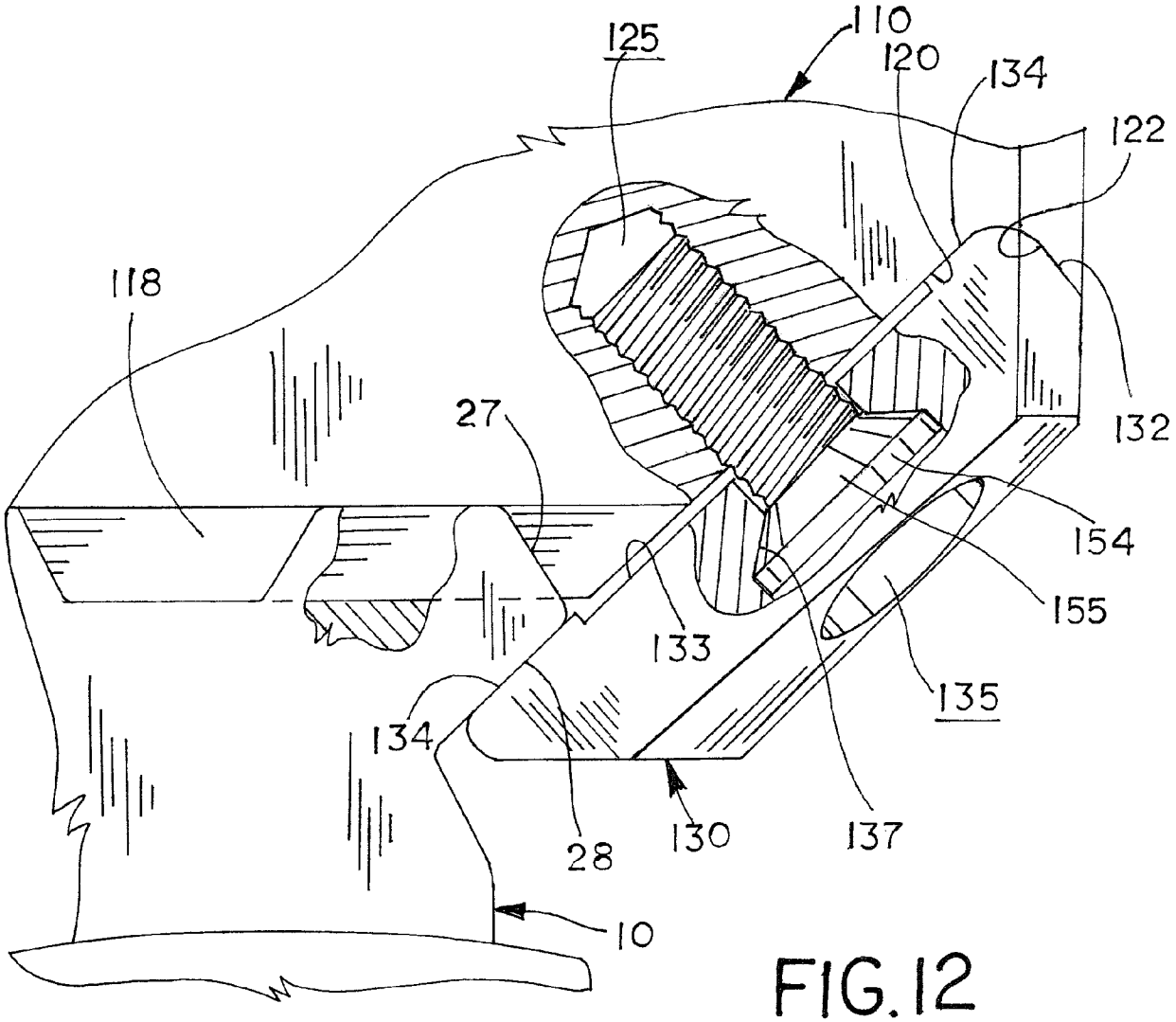
FIG. 12 is another partial end view of the scope ring of FIG. 1 showing the rail clamping member tightened to the base member to secure the scope ring to the Weaver style rail base.

As shown in FIGS. 8-12, rail base 10 is an elongated metal structure that is machined to define a number of evenly spaced upwardly extending rail projections 20 with evenly spaced transverse slots 21 there between to provide for selective location of an optical device (not shown) on a firearm (also not shown). The sides of each rail projection have parallel angulated contact surfaces that form the "mounting rails" of base 10. Each of the mounting projections 20 has a flat top surface 22 mounting surface and opposite transverse edges that are beveled to form a "dove tail" cross sectional profile with a pair of oppositely angulated upper side surfaces 25 and 27, and a pair of oppositely angulated lower side surfaces 26 and 28. Both angulated upper side surfaces 25 and 27 and angulated lower side surfaces 26 and 28 are oriented at 45° angles with respect to the horizontal plane of top surface 22.

As shown in FIGS. 1-7, scope ring 100 includes three main components: a base member 110, a rail clamping member 130 and a scope clamping member 140. Base member 110, rail clamping member 130 and scope clamping member 140 are forged and/or machined pieces of metal, such as steel or aluminum. Scope clamping member 140 bolts to base member 110 around the optical sight (not shown) to securely retain the sight within scope rings 100. Both base member 110 and clamping member 130 have opposed arcuate inner surfaces 123 and 143, respectively that define an opening 151 for receiving the tubular body of an optical sight 2. Scope clamping member 140 is secured to base member 110 by fasteners 152, which extend through recessed bores 147 in scope clamp member 140 and turn into threaded bores 127 in base member 110.

Rail clamping member 130 also bolts to base member 110 to form part of the rail mounting mechanism of this invention. The bottom of base member 110 is configured to have a base or rail receiving area 111 defined by a flat bottom contact surface 112 and an angulated contact surface 114, which are angled and oriented for contact with correspondingly angulated lower side surface 26 of rail base 10. A locking rib or bar 118 extends downward from and traverses bottom contact surface 112. Base member 110 also has an angulated outer contact surface 120, which is oriented for contact with rail clamping member 130. It should be noted that contact surface 120 is oriented at approximately 45° angle with respect to the plane of bottom contact surface 112. In addition, base member 110 has a rounded inner shoulder that converges into outer contact surface 120 and terminates in a arcuate lower edge 124. The inside of rail clamping member 130 has a flat recessed surface 133 defined between two flat contact areas or feet 134. One end of clamping member 130 has a rounded edge 136 and a flat outer face 132, which are configure to nest against shoulder 122.

Rail clamping member 130 is bolted to base member 110 by self-centering—Weaver style fasteners 154. Fasteners 154 have a conical lower head surface 155, which allows them to self-center within similarly contoured bores. Fasteners 154 may also use Torx, Allen or any other suitable screw heads as desired. Fasteners 154 extend through recessed bores 135 in rail clamp member 130 and turn into threaded bores 125 in base member 110. Threaded bores 125 extend into base member 110 along a bore axis that is angled at approximately 45° with respect to the plane of bottom contact surface 112. Recessed bores 135 have an internal conical shoulder 137 within which conical lower head surface 155 of fastener 154 sits.

FIGS. 8-11 illustrate the operation of the rail clamping mechanism of this invention. Base member 110 slides laterally onto rail base 10 from one side with bottom contact surface 112 resting squarely on top surface 22 of one or more rail protrusions 20. Locking bar 118 seats within one of slots 21 between adjacent rail protrusions 20 to prevent scope ring 100 from sliding forward or back along the length of the base rail. Base member 110 is slide laterally until contact surface 114 abuts lower clamping surface 126 of rail protrusions 20. When bolted to base member 110, rail clamping member 130 abuts against both outer contact surface 120 of base member 20 and lower contact surface 28 of rail base 10. Recessed surface 133 of rail clamping member 130 is spaced from surface 120 to provide an open gap for accommodating any dimensional variations between the rail base 20 and base member 110 and insure sufficient clamping force. Because of the angular orientation of rail clamping member 130 and fasteners 154 with respect to base member 110, drawing down fasteners 154 generates a clamping force having both a vertical and lateral vector. Tightening fasteners 154 simultaneously draws contact surface 120 of base member 110 and contact foot 134 of rail clamping member 130 laterally inward against lower side surfaces 26 and 28 of rail base 20 and bottom contact surface 112 of base member 110 vertically downward against top 22 of mounting mount 10.

In addition, self-centering fasteners 154 along with the geometry of the various contacting and mating surfaces between base member 110 and rail clamping member 130 facilitate a "floating action" of the rail clamping member as it is drawn against the base member. Play between fasteners 154 and walls of bore 135 and conical shoulder 137 in rail clamping member 130 allows the rail clamping member to "float" i.e., pivot slightly in all directions, as the fasteners are turned into threaded bores 125 and tightened. This floating action allows all the contact and mating surfaces to properly align and seat squarely against one another. As fasteners 154 are tightened, the conical head surface 155 nests against concial shoulder 137. Simultaneously, the rounded edge 136 and outer face 132 of rail clamping member 130 nests up under and against rounder shoulder 122 of base member 110, locking the rail clamping member against base member 110. The curvature of edge 124 allows rail clamping member to adjustably seat and squarely nest under shoulder 122. When drawn tight, the "floating action" ceases and the clamping member 130 "locks up" against base member 110 with the clamping force evenly applied across all contacting and mating surfaces.

One skilled in the art will note that the clamping mechanism of this invention provides a stronger and more stable connection than conventional clamping mechanisms for Weaver and Pictanny style rail bases and rails. While conventional rings and mounts rely on a lateral clamping force to securely hold their clamping surfaces against the sides of the rail bases and rails, the clamping mechanism of this invention provides a clamping force that is applied both laterally and vertically to hold the rings or mounts to the rail base or rail. The rail clamping member is bolted to the base member at an angle, which draws the base member both laterally inward against the sides of the rail base or rail and vertically downward against the top of the rail base or rail. Because the clamping force that holds the mounts to the rail base is applied both laterally and vertically, the connection "locks up" tightly and evenly so that unequal mechanical stress is not placed on either the mount or the rail base. In addition, the "floating action" created by self-centering fasteners and the geometry of the various mating surfaces between the base member and the clamping member allow the clamping mechanism to accommodate for any dimensional variances between the components, as well as helping ensure that the clamping force is applied evenly across all contacting and mating surfaces.

It should be noted that although the clamping force in the embodiment of the clamping mechanism illustrated and described herein is provided by threaded fasteners, in other embodiments it may take other mechanical forms. For example, cams and levers may be adapted to provide the angular clamping force. It is contemplated that such cams, levers and other devices be arranged in a "quick release" mechanism to allow the rings and mounts to be quickly donned and doffed, while still providing the necessary angular clamping force. The use of such quick release mechanisms in Weaver and Picatinny style rail mounts is well known in the art and may be incorporated and adapted to the clamping mechanism within the teachings of this invention.

The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A clamping mechanism for securing mounts to a Weaver or Picatinny style rail where the rail includes a plurality of upwardly facing mounting projections each having a flat top surface, opposed first and second angulated side surfaces, the mechanism comprising:

a base member having a rail receiving opening defined by a flat bottom contact surface and an angulated contact surface, the base also having an angulated clamping surface;

a clamping member having opposed first and second ends thereof; and means for connecting the clamping member against the base member in a force transmitting locking engagement at an angle with respect to the bottom contact surface to secure the rail between the base member and the clamping member so that one of the first and second ends of the clamping member abuts the clamping surface and the other of the first and second ends of the clamping member abuts one of the opposed first and second angulated side surfaces of the rail, thereby drawing the angulated contact surface of the base member forceably pressing against the other angulated side surface of the rail and the bottom contact surface of the base member forceably pressing against the top surface of the rail.

2. The clamping mechanism of claim 1 wherein the clamping means includes a threaded fastener extending through a perpendicular through bore in the clamping member and turned into a threaded bore in the base member when the clamping member is connected to the base member.

3. The clamping mechanism of claim 2 wherein the threaded bore is axially perpendicular to the plane of the clamping surface of the base member and is axially angled with respect to the plane of the bottom contact surface of the base member.

4. The clamping mechanism of claim 2 wherein the fastener is a self-centering fastener.

5. The clamping mechanism of claim 1 wherein the base member has a shoulder defined therein, the angulated clamping surface terminating at the shoulder, the one of the first and second contact end nests against the shoulder when the clamping member is connected to the base member.

6. The clamping means of claim 1 wherein the clamping member defines a flat contact foot at each of the first and second ends and a recessed area therebetween.

7. The clamping means of claim 1 wherein the base member includes a locking bar extending downward from and laterally across the bottom contact surface.

8. A clamping mechanism for securing mounts to a Weaver or Picatinny style rail where the rail includes a plurality of upwardly facing mounting projections each having a flat top surface, opposed first and second angulated side surfaces, the mechanism comprising:

a base member having a rail receiving opening defined by a flat bottom contact surface and an angulated contact surface, the base also having an angulated clamping surface;

a clamping member secured to the base member by a threaded fastener that extends through a perpendicular through bore in the clamping member and turns into a threaded bore in the base member at an angle with respect to the bottom contact surface in a force transmitting locking engagement to secure the rail between the base member, whereby the angulated contact surface of the base member forceably presses against one of the opposed first and second angulated side surfaces of the rail and the bottom contact surface of the base member forceably presses against the top surface of the rail.

9. The clamping mechanism of claim 8 wherein the clamping member having opposed first and second ends thereof where one of the first and second ends of the clamping member forceably abuts the clamping surface and the other of the first and second ends of the clamping member abuts the other of the opposed first and second angulated side surfaces of the rail.

10. The clamping mechanism of claim 8 wherein the base member has a shoulder defined therein, the angulated clamping surface terminating at the shoulder, the one of the first and second contact end nests against the shoulder when the clamping member is connected to the base member.

11. The clamping mechanism of claim 8 wherein the clamping member defines a flat contact foot at each of the first and second ends and a recessed area therebetween.

12. The clamping mechanism of claim 8 wherein the base member includes a locking bar extending downward from and laterally across the bottom contact surface.

13. The clamping mechanism of claim 8 wherein the fastener is a self-centering fastener.

14. A scope ring for securing optical sights to a Weaver or Picatinny style rail where the rail includes a plurality of upwardly facing mounting projections each having a flat top surface, opposed first and second angulated side surfaces, the scope ring comprising:

a base member having a rail receiving opening defined by a flat bottom contact surface and an angulated contact surface, the base also having an angulated clamping surface;

a scope clamping member secured to the base member for supporting the optical sight therebetween;

a rail clamping member secured to the base member by a threaded fastener that extends through a perpendicular through bore in the clamping member and turns into a threaded bore in the base member at an angle with respect to the bottom contact surface in a force transmitting locking engagement to secure the rail between the base member, whereby the angulated contact surface of the base member forceably presses against one of the opposed first and second angulated side surfaces of the rail and the bottom contact surface of the base member forceably presses against the top surface of the rail.

15. The scope ring of claim 14 wherein the clamping member having opposed first and second ends thereof where one of the first and second ends of the clamping member forceably abuts the clamping surface and the other of the first and second ends of the clamping member abuts the other of the opposed first and second angulated side surfaces of the rail.

16. The scope ring of claim 14 wherein the base member has a shoulder defined therein, the angulated clamping surface terminating at the shoulder, the one of the first and second contact end nests against the shoulder when the clamping member is connected to the base member.

17. The scope ring of claim 14 wherein the clamping member defines a flat contact foot at each of the first and second ends and a recessed area therebetween.

18. The scope ring of claim 14 wherein the base member includes a locking bar extending downward from and laterally across the bottom contact surface.

19. The scope ring of claim 14 wherein the fastener is a self-centering fastener.

* * * * *